US008854401B2

(12) United States Patent
Chen et al.

(10) Patent No.: US 8,854,401 B2
(45) Date of Patent: Oct. 7, 2014

(54) SYSTEM AND METHOD TO IMPROVE IMAGE EDGE DISCOLORATION

(75) Inventors: Cheng Chen, Cupertino, CA (US); Shih Chang Chang, Cupertino, CA (US); Mingxia Gu, Santa Clara, CA (US); John Z. Zhong, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 562 days.

(21) Appl. No.: 12/979,768

(22) Filed: Dec. 28, 2010

(65) Prior Publication Data

US 2012/0162156 A1 Jun. 28, 2012

(51) Int. Cl.

| | |
|---|---|
| ***G09G 5/02*** | (2006.01) |
| ***G09G 5/10*** | (2006.01) |
| ***G09G 5/00*** | (2006.01) |
| ***G09G 3/36*** | (2006.01) |

(52) U.S. Cl.

CPC ..... *G09G 3/3648* (2013.01); *G09G 2310/0232* (2013.01); *G09G 2310/061* (2013.01); *G09G 2300/043* (2013.01); *G09G 2320/0242* (2013.01); *G09G 2320/0209* (2013.01)

USPC ..... 345/694; 345/204; 345/690; 345/691; 345/82; 345/83; 345/87; 345/88; 345/89; 345/94

(58) Field of Classification Search

USPC ..... 345/204, 690, 691, 694, 82, 83, 87–89, 345/94

See application file for complete search history.

(56) References Cited

U.S. PATENT DOCUMENTS

| | | | | |
|---|---|---|---|---|
| 6,115,092 | A * | 9/2000 | Greene et al. | 349/74 |
| 6,618,108 | B2 * | 9/2003 | Koyama | 349/110 |
| 7,405,793 | B2 * | 7/2008 | Rosselli et al. | 349/141 |
| 7,515,227 | B2 * | 4/2009 | Takizawa | 349/114 |
| 7,671,832 | B2 * | 3/2010 | Lankhorst et al. | 345/102 |
| 7,701,429 | B2 * | 4/2010 | Kim et al. | 345/87 |
| 8,242,997 | B2 * | 8/2012 | Lee et al. | 345/92 |
| 8,339,560 | B2 * | 12/2012 | Tojo et al. | 349/143 |
| 8,351,006 | B2 * | 1/2013 | Ryu et al. | 349/141 |
| 2004/0076336 | A1 | 4/2004 | Bassi et al. | |
| 2009/0257676 | A1 * | 10/2009 | Naka | 382/264 |
| 2010/0007589 | A1 * | 1/2010 | Yeo et al. | 345/83 |
| 2012/0113154 | A1 * | 5/2012 | Ge et al. | 345/690 |

FOREIGN PATENT DOCUMENTS

WO 0120391 A1 3/2001

* cited by examiner

*Primary Examiner* — Ilana Spar

(74) *Attorney, Agent, or Firm* — Kendall P. Woodruff

(57) ABSTRACT

Present techniques involve methods and systems for reducing edge discoloration in a display. In one embodiment, the first and last columns of a display are dimmed by adjusting a black mask or reducing transmittance of the relevant pixels. Further, the first and last columns of a display may be entirely covered by the black mask. In some embodiments, using a coupling extrusion on a neighboring sub-pixel can be used to control the coupling between the neighboring sub-pixels to reduce edge discoloration. Display software may also be used to reduce edge discoloration. For example, software may automatically reduce the brightness of the first and last column. In some embodiments, software may be used to detect edges of objects within the display area. Edges of an object are detected, and the last sub-pixel of the background and/or the first sub-pixel of the object are compensated.

20 Claims, 9 Drawing Sheets

SYSTEM AND METHOD TO IMPROVE IMAGE EDGE DISCOLORATION

BACKGROUND

The present disclosure relates generally to control of a display device.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including such consumer electronics as televisions, computers, and handheld devices (e.g., cellular telephones, audio and video players, gaming systems, and so forth). Such LCD devices typically provide a flat display in a relatively thin package that is suitable for use in a variety of electronic goods. In addition, such LCD devices typically use less power than comparable display technologies, making them suitable for use in battery-powered devices or in other contexts where it is desirable to minimize power usage.

LCDs typically include an LCD panel having, among other things, a plurality of picture elements (pixels) arranged in a matrix to display an image. Each pixel may include sub-pixels (e.g., red, blue, and green sub-pixels) which variably permit light to pass when an electric field is applied to a liquid crystal material in each sub-pixel. However, adjacent columns of sub-pixels in an LCD panel may be susceptible to electrical coupling (also referred to as crosstalk), which may manifest as undesirable visual artifacts in the LCD display. Moreover, due to the arrangement of sub-pixels in a pixel matrix and/or due to the images to be displayed by the LCD, crosstalk may sometimes have non-uniform affects over a display area, resulting in non-uniform visual artifacts in the displayed image. In particular, edge discoloration along edges of a display active area or along edges of a displayed object may result from such crosstalk effects.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Techniques of the present disclosure relate to systems and methods for reducing edge discoloration in an LCD display. An LCD display typically includes a matrix of pixels, defined by columns and rows of sub-pixels (i.e., red, blue, and green sub-pixels in each pixel). Due to the configuration of a typical pixel matrix, coupling, interference, or other electromagnetic effects may occur between sub-pixel columns. Such effects may result in undesirable visual artifacts such as edge discoloration in the display area and/or edge discoloration in an object displayed on the LCD. Edge discoloration may refer to a non-uniformity in light transmittance through a first sub-pixel column (e.g., a left edge of the display or object) and a last sub-pixel column (e.g., a right edge of the display or object) with respect to the light transmittance through other sub-pixels in the display or in the object (e.g., the sub-pixels between the left and right edges). The non-uniformity in light transmittance may include, for example, a higher light transmittance through the first and last sub-pixel columns of a display or of an object due to relatively higher crosstalk between sub-pixels in the other portions of the display.

One or more embodiments involve techniques for dimming the first and last sub-pixel columns of a display to mitigate edge discoloration. For example, to reduce edge discoloration in a display area, a black mask over the first and last columns of sub-pixels may be configured to reduce light transmittance through those sub-pixels, or electrodes in the relevant sub-pixels may be shaped for reduced light transmittance. Furthermore, software may be utilized to automatically reduce the brightness of the first and last sub-pixel columns. Embodiments also include techniques for mitigating edge discoloration in objects displayed on the LCD. In some embodiments, software may be used to detect edges of objects within the display area. Once object edges are detected, the last sub-pixel of the background and/or the first sub-pixel of the object are driven to reduce edge discoloration perceptibility. In some embodiments, each sub-pixel may be configured with a coupling extrusion on the pixel electrode to control a coupling effect between the neighboring sub-pixels to reduce edge discoloration perceptibility.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
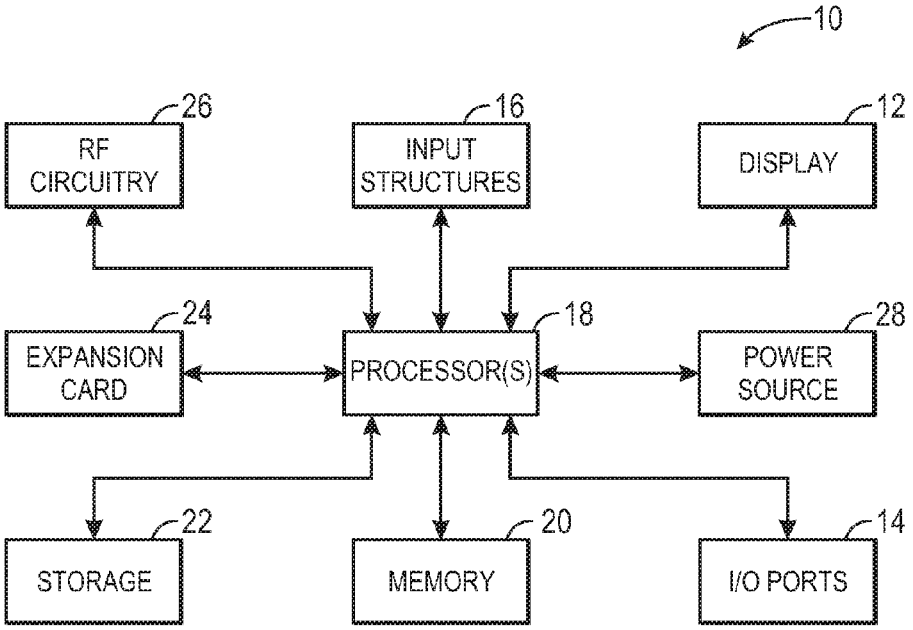
FIG. 1 is a block diagram of an electronic device, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure are generally directed to methods and systems for reducing edge discoloration in an LCD display. Edge discoloration may refer to a non-uniformity in light transmittance through a first sub-pixel column (e.g., a left edge of the display or a displayed object) and a last sub-pixel column (e.g., a right edge of the display or displayed object) with respect to the light transmittance through other sub-pixels in the display or in the object (e.g., the sub-pixels between the left and right edges). The non-uniformity in light transmittance may include, for example, a higher transmittance of light through the first and last sub-pixel columns of a display or of an object due to relatively higher crosstalk effects between sub-pixels in the portions of the display between the first and last sub-pixel columns.

Various embodiments include techniques for mitigating edge discoloration in edges of a display area and/or edges of a displayed object. Some embodiments for reducing edge discoloration in display area edges involve dimming the first and last sub-pixel columns of a display area. For example, a black mask over the first and last columns of sub-pixels may be configured to reduce light transmittance, or electrodes in the relevant sub-pixels may be shaped for reduced light transmittance through those sub-pixels. Furthermore, software may be utilized to automatically reduce the brightness of the first and last sub-pixel columns in a display area. Embodiments also include techniques for mitigating edge discoloration in objects displayed on the LCD. In some embodiments, software may be used to detect edges of objects within the display area. Once object edges are detected, the last sub-pixel of the background and/or the first sub-pixel of the object are driven to reduce edge discoloration perceptibility. In some embodiments, each sub-pixel may be configured with a coupling extrusion on the pixel electrode to control a coupling effect between the neighboring sub-pixels to reduce edge discoloration perceptibility. With these foregoing features in mind, a general description of electronic devices including a display that may use the presently disclosed technique is provided below.

As may be appreciated, electronic devices may include various internal and/or external components which contribute to the function of the device. For instance, FIG. 1 is a block diagram illustrating components that may be present in one such electronic device 10. Those of ordinary skill in the art will appreciate that the various functional blocks shown in FIG. 1 may include hardware elements (including circuitry), software elements (including computer code stored on a computer-readable medium, such as a hard drive or system memory), or a combination of both hardware and software elements. FIG. 1 is only one example of a particular implementation and is merely intended to illustrate the types of components that may be present in the electronic device 10. For example, in the presently illustrated embodiment, these components may include a display 12, input/output (I/O) ports 14, input structures 16, one or more processors 18, one or more memory devices 20, non-volatile storage 22, expansion card(s) 24, networking device (RF circuitry) 26, and power source 28.

The display 12 may be used to display various images generated by the electronic device 10. The display 12 may be any suitable display, such as a liquid crystal display (LCD) or an organic light-emitting diode (OLED) display. Additionally, in certain embodiments of the electronic device 10, the display 12 may be provided in conjunction with a touch-sensitive element, such as a touchscreen, that may be used as part of the control interface for the device 10. The display 12 may include an LCD panel configured to reduce edge discoloration. In some embodiments, the LCD panel may include a matrix of pixels configured to be driven to mitigate edge discoloration.

Processors 18 may provide the processing capability to execute the operating system, programs, user and application interfaces, and any other functions of the electronic device 10. The processors 18 may include one or more microprocessors, such as one or more "general-purpose" microprocessors, one or more special-purpose microprocessors or ASICS, or some combination of such processing components. For example, the processors 18 may include one or more reduced instruction set (RISC) processors, as well as graphics processors, video processors, audio processors, and the like. As will be appreciated, the processors 18 may be communicatively coupled to one or more data buses or chipsets for transferring data and instructions between various components of the electronic device 10.

Programs or instructions executed by processor(s) 18 may be stored in any suitable manufacture that includes one or more tangible, computer-readable media at least collectively storing the executed instructions or routines, such as, but not limited to, the memory devices and storage devices described below. Also, these programs (e.g., an operating system) encoded on such a computer program product may also include instructions that may be executed by the processors 18 to enable the device 10 to provide various functionalities, including those described herein.

The instructions or data to be processed by the one or more processors 18 may be stored in a computer-readable medium, such as a memory 20. The memory 20 may include a volatile memory, such as random access memory (RAM), and/or a non-volatile memory, such as read-only memory (ROM). The memory 20 may store a variety of information and may be used for various purposes. For example, the memory 20 may store firmware for electronic device 10 (such as basic input/output system (BIOS)), an operating system, and various other programs, applications, or routines that may be executed on electronic device 10. In addition, the memory 20 may be used for buffering or caching during operation of the electronic device 10.

The components of the device 10 may further include other forms of computer-readable media, such as non-volatile storage 22 for persistent storage of data and/or instructions. Non-volatile storage 22 may include, for example, flash memory, a hard drive, or any other optical, magnetic, and/or solid-state storage media. Non-volatile storage 22 may be used to store firmware, data files, software programs, wireless connection information, and any other suitable data.

Figure 2:
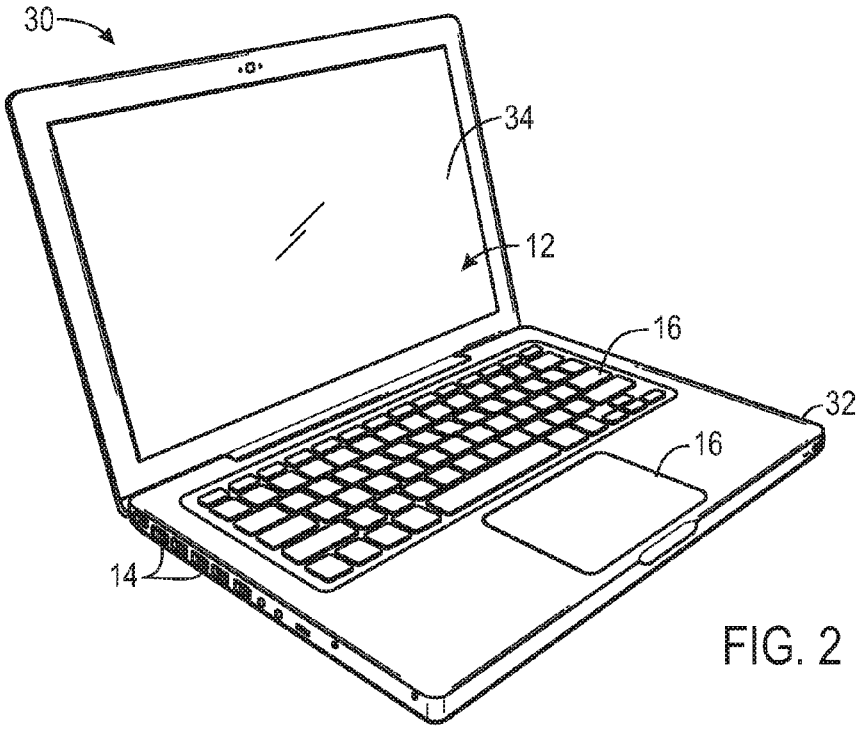
FIG. 2 is a perspective view of a computer in accordance with aspects of the present disclosure.

The electronic device 10 may take the form of a computer system or some other type of electronic device. Such computers may include computers that are generally portable (such as laptop, notebook, tablet, and handheld computers), as well as computers that are generally used in one place (such as conventional desktop computers, workstations and/or servers). In certain embodiments, electronic device 10 in the form of a computer may include a model of a MacBook®, MacBook® Pro, MacBook Air®, iMac®, Mac® mini, or Mac Pro® available from Apple Inc. of Cupertino, Calif. By way of example, an electronic device 10 in the form of a laptop computer 30 is illustrated in FIG. 2 in accordance with one embodiment. The depicted computer 30 includes a housing 32, a display 12 (e.g., in the form of an LCD 34 or some other suitable display), I/O ports 14, and input structures 16.

The display 12 may be integrated with the computer 30 (e.g., such as the display of the depicted laptop computer) or may be a standalone display that interfaces with the computer 30 using one of the I/O ports 14, such as via a DisplayPort, Digital Visual Interface (DVI), High-Definition Multimedia Interface (HDMI), or analog (D-sub) interface. For instance, in certain embodiments, such a standalone display 12 may be a model of an Apple Cinema Display®, available from Apple Inc.

Figure 3:
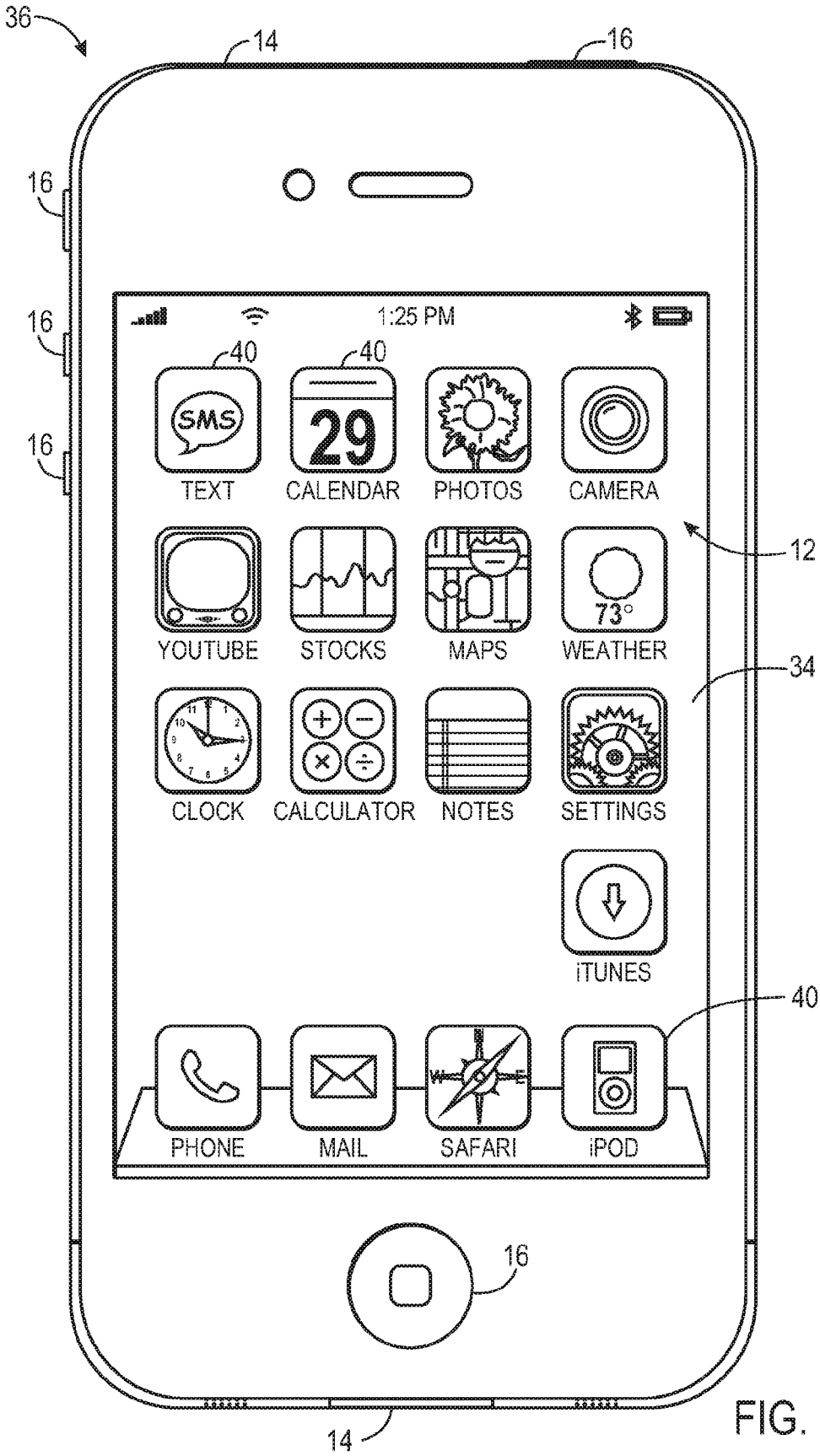
FIG. 3 is a perspective view of a handheld electronic device in accordance with aspects of the present disclosure.

Although an electronic device 10 is generally depicted in the context of a computer in FIG. 2, an electronic device 10 may also take the form of other types of electronic devices. In some embodiments, various electronic devices 10 may include mobile telephones, media players, personal data organizers, handheld game platforms, cameras, and combinations of such devices. For instance, as generally depicted in FIG. 3, the device 10 may be provided in the form of handheld electronic device 36 that includes various functionalities (such as the ability to take pictures, make telephone calls, access the Internet, communicate via email, record audio and video, listen to music, play games, and connect to wireless networks). By way of further example, handheld device 36 may be a model of an iPod®, iPod® Touch, or iPhone® available from Apple Inc. In the depicted embodiment, the handheld device 32 includes the display 12, which may be in the form of an LCD 34. The LCD 34 may display various images generated by the handheld device 32, such as a graphical user interface (GUI) 38 having one or more icons 40.

In another embodiment, the electronic device 10 may also be provided in the form of a portable multi-function tablet computing device (not illustrated). In certain embodiments, the tablet computing device may provide the functionality of two or more of a media player, a web browser, a cellular phone, a gaming platform, a personal data organizer, and so forth. By way of example only, the tablet computing device may be a model of an iPad® tablet computer, available from Apple Inc.

With the foregoing discussion in mind, it may be appreciated that an electronic device 10 in either the form of a handheld device 30 (FIG. 2) or a computer 50 (FIG. 3) may be provided with a display device 10 in the form of an LCD 34. As discussed above, an LCD 34 may be utilized for displayed respective operating system and/or application graphical user interfaces running on the electronic device 10 and/or for displaying various data files, including textual, image, video data, or any other type of visual output data that may be associated with the operation of the electronic device 10.

Figure 4:
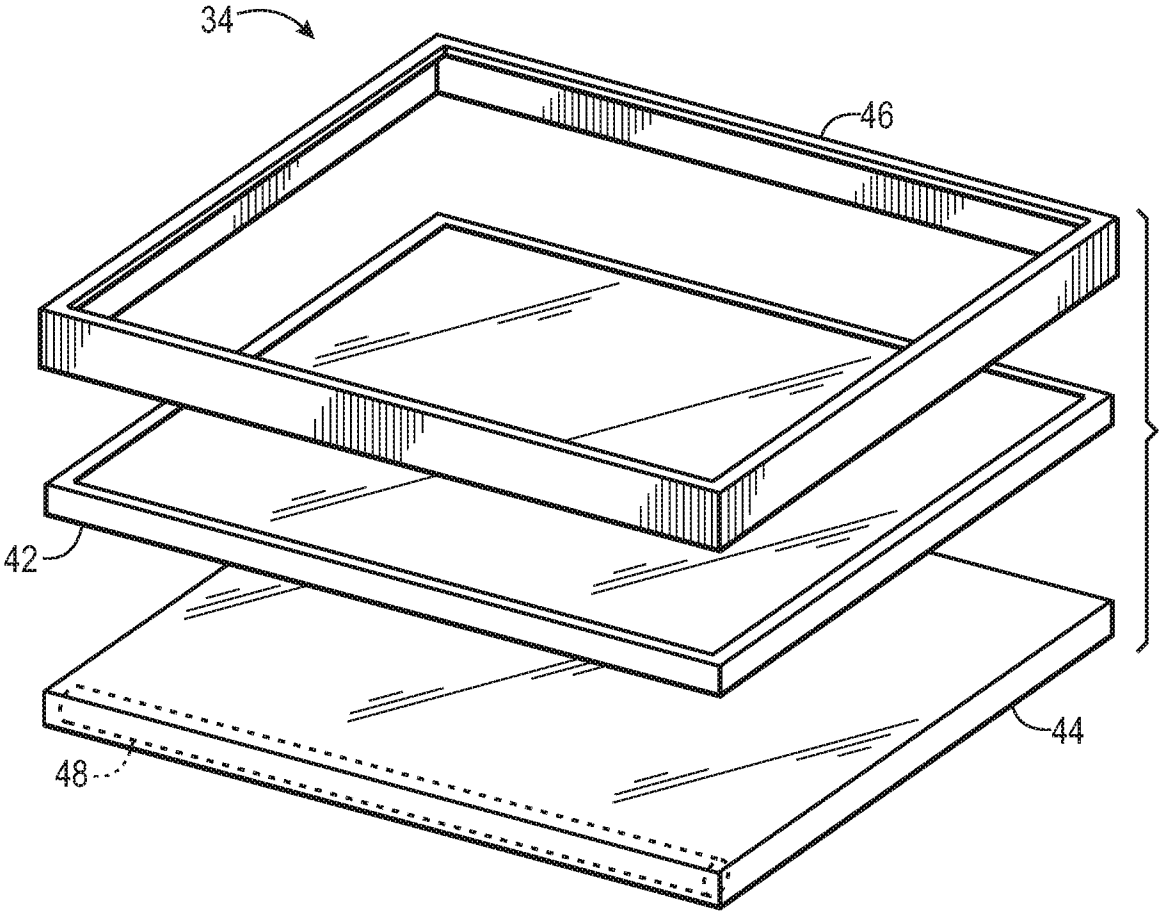
FIG. 4 is an exploded view of a liquid crystal display (LCD) in accordance with aspects of the present disclosure.

One example of an LCD display 34 is depicted in FIG. 4 in accordance with one embodiment. The depicted LCD display 34 includes an LCD panel 42 and a backlight unit 44, which may be assembled within a frame 46. As may be appreciated, the LCD panel 42 may include an array of pixels configured to selectively modulate the amount and color of light passing from the backlight unit 44 through the LCD panel 42. For example, the LCD panel 42 may include a liquid crystal layer, one or more thin film transistor (TFT) layers configured to control orientation of liquid crystals of the liquid crystal layer via an electric field, and polarizing films, which cooperate to enable the LCD panel 42 to control the amount of light emitted by each pixel. Additionally, the LCD panel 42 may include a black mask and color filter layer having colored filters that allow specific colors of light to be emitted from the pixels (e.g., red, green, and blue).

The backlight unit 44 includes one or more light sources 48. Light from the light source 48 is routed through portions of the backlight unit 44 (e.g., a light guide and optical films) and generally emitted toward the LCD panel 42. In various embodiments, light source 48 may include a cold-cathode fluorescent lamp (CCFL), one or more light emitting diodes (LEDs), organic light emitting diodes (OLEDs), or any other suitable source(s) of light. Further, although the LCD 34 is generally depicted as having an edge-lit backlight unit 44, it is noted that other arrangements may be used (e.g., direct backlighting) in full accordance with the present technique.

Figure 5:
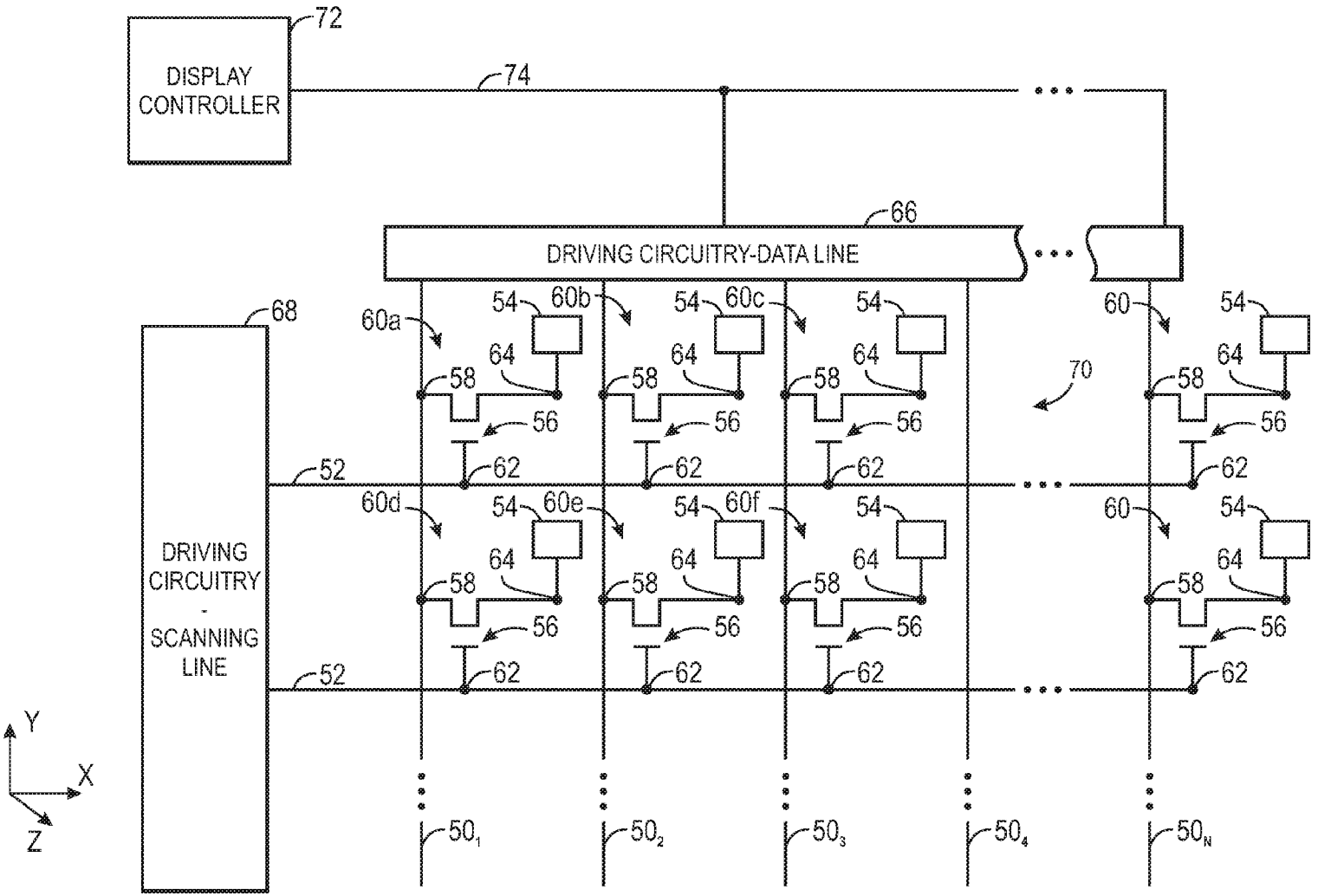
FIG. 5 graphically depicts circuitry that may be found in the LCD of FIG. 4 in accordance with aspects of the present disclosure.

Referring now to FIG. 5, an example of a circuit view of pixel-driving circuitry found in an LCD 34 is provided. For example, the circuitry depicted in FIG. 5 may be embodied on the LCD panel 42 described above with respect to FIG. 4. The pixel-driving circuitry includes an array or matrix 70 of unit pixels 60 that are driven by data (or source) line driving circuitry 66 and scanning (or gate) line driving circuitry 68. Data signals may be transmitted to the data line driving circuitry 66 and the scanning line driving circuitry 68 by a display controller 72. As depicted, the matrix 70 of unit pixels 60 (represented by pixels 60*a*-60*f* in this illustration) forms an image display region of the LCD 34. In such a matrix, each unit pixel 60 may be defined by the intersection of data lines 50 and scanning lines 52, which may also be referred to as source lines 50 and gate lines 52. The data line driving circuitry 66 may include one or more driver integrated circuits (also referred to as column drivers) for driving the data lines 50. The scanning line driving circuitry 68 may also include one or more driver integrated circuits (also referred to as row drivers). By way of example, in a color LCD panel 34 having a display resolution of 960×640, each of the 960 pixel columns may include a group of data lines 50 (e.g., corresponding to red, green, or blue unit pixels in some embodiments), and each data line 50 may include 640 pixel rows. Each data line 50 may correspond to a column of unit pixels 60. Further, each of the 640 scanning lines 52, (defining a row in some embodiments) may include 960 groups of unit pixels. For example, some embodiments of the LCD panel 34 may be a model of the Retina™ display, available from Apple Inc.

Each unit pixel 60 includes a pixel electrode 54 and thin film transistor (TFT) 56 for switching the pixel electrode 54. In the depicted embodiment, the source 58 of each TFT 56 is electrically connected to a data line 50, extending from respective data line driving circuitry 66. Similarly, in the depicted embodiment, the gate 62 of each TFT 56 is electrically connected to a scanning or gate line 52, extending from respective scanning line driving circuitry 68. In one embodiment, column drivers of the data line driving circuitry 66 may send image signals, also referred to as data signals, to the pixels 60 by way of the respective data lines 50. In some embodiments, the transmission of data signals may be controlled by the display controller 72. Data signals may be generated by the display controller 72 and transmitted to the data line driving circuitry 66 via a data line 74. Specifically, the data signals may generally include image data to be processed by data line driving circuitry 66 of the LCD 34 to drive the pixels 60 and render an image on the LCD 34.

The scanning lines 52 may apply scanning signals from the scanning line driving circuitry 68 to the respective gates 62 of each TFT 56 to which the respective scanning lines 52 are connected. Such scanning signals may be applied by line-sequence with a predetermined timing or in a pulsed manner. Each TFT 56 serves as a switching element which may be activated and deactivated (i.e., turned on and off) for a predetermined period based on the respective presence or absence of a scanning signal at its gate 62. When activated, a TFT 56 may store the data signals received via a respective data line 50 as a charge in the pixel electrode 54 with a predetermined timing.

The data signal may be stored at the pixel electrode 54 and used to generate an electrical field between the respective pixel electrode 54 and a common electrode. Such an electrical field may align liquid crystals within a liquid crystal layer to modulate light transmission through the LCD panel 42. In some embodiments, each unit pixel electrode 54 may include a number of "finger" electrodes, i.e. strips of electrode plates which are electrically connected as a unit pixel 60. For example, a unit pixel 60 may have one or multiple parallel finger electrodes, and in other embodiments, other configurations may be possible. Further, in some embodiments, a storage capacitor may also be provided in parallel to the liquid crystal capacitor formed between the pixel electrode 54 and the common electrode to prevent leakage of the stored image signal at the pixel electrode 54. For example, such a storage capacitor may be provided between the drain 64 of the respective TFT 56 and a separate capacitor line.

Unit pixels 60 may operate in conjunction with various color filters, such as red, green, and blue filters. In such embodiments, a "pixel" of the display may actually include multiple unit pixels, also referred to as sub-pixels, such as a red sub-pixel (e.g., 60*a*), a green sub-pixel (e.g., 60*b*), and a blue sub-pixel (e.g., 60*c*), each of which may be modulated to increase or decrease the amount of light emitted to enable the display to render numerous colors via additive mixing of the colors.

However, due to the proximity of sub-pixels 60 along the direction of the gate lines 52 (x-direction), each sub-pixel 60 may be affected by crosstalk, which may refer to electrical coupling and other electromagnetic effects between adjacent sub-pixels 60 along the x-direction. Specifically, the electric field generated at each sub-pixel 60 in response to the data signals driven through the respective data lines 50 may affect the electric field generated at an adjacent sub-pixel 60 in the x-direction, thereby affecting the alignment of liquid crystals in the liquid crystal layer of the affected sub-pixels 60 and reducing the transmittance of light through the LCD panel 42.

Due to the configuration of sub-pixels 60 in the pixel matrix 70, certain portions of a display area in an LCD 34 may be affected by crosstalk differently. For example, each of the sub-pixels 60 connected to a first data line $\mathbf{50}_1$ may only be affected by crosstalk from one adjacent sub-pixel 60 (e.g., sub-pixels 60 connected to the second data line $\mathbf{50}_2$) along the x-direction. Similarly, sub-pixels 60 connected to a last data line $\mathbf{50}_n$ may also only be affected by crosstalk from one adjacent sub-pixel $\mathbf{50}_{n-1}$ in the x direction. However, the other sub-pixels 60 of the pixel matrix 70 between the first and last data line $\mathbf{50}_1$ and $\mathbf{50}_n$, such as the sub-pixels 60 connected to the data lines $\mathbf{50}_2$, $\mathbf{50}_3$, and $\mathbf{50}_4$, may be affected by crosstalk between one adjacent sub-pixel 60 on either side in the x-direction. Therefore, the sub-pixels 60 between the first and last data line $\mathbf{50}_1$ and $\mathbf{50}_n$ are affected by crosstalk from two adjacent sub-pixels 60, rather than just one. As the sub-pixels 60 of the first and last data lines $\mathbf{50}_1$ and $\mathbf{50}_n$ are generally less affected by less crosstalk (e.g., by about one half) compared to the sub-pixels 60 having two adjacent sub-pixels 60 along the x-direction, the sub-pixels 60 of the first and last data lines $\mathbf{50}_1$ and $\mathbf{50}_n$ may generally transmit a greater amount of light than other sub-pixels 60 in the display area. Such effects may be perceived as greater light transmission at the y-direction edges (parallel to the data lines 50), or the edges of the display area over data lines $\mathbf{50}_1$ and $\mathbf{50}_n$.

Figure 6:
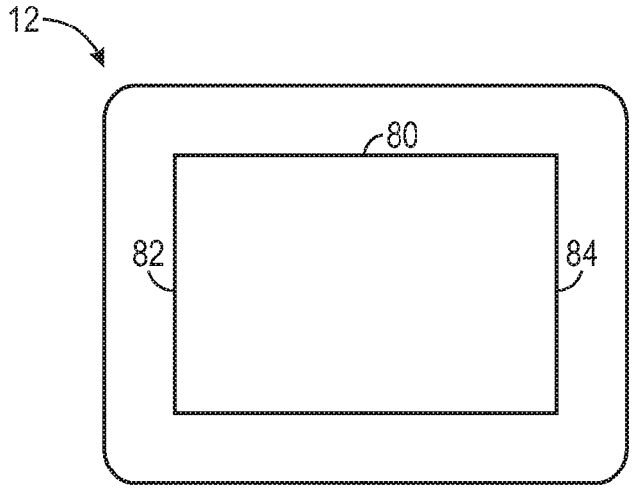
FIG. 6 is an illustration of edge discoloration in the display area of the LCD of FIG. 4 in accordance with aspects of the present disclosure.

Moreover, as the same color of a color filter may typically be associated with the sub-pixels 60 connected to a common data line 50, variations in light transmittance may also affect the chromaticity of the LCD panel 42. The higher light transmission at the y-direction edges (e.g., along the data lines $\mathbf{50}_1$ and $\mathbf{50}_n$), referred to as edges, may manifest as edge discolorations along the display area edges, as illustrated in FIG. 6. For example, a pixel typically includes a red sub-pixel 60*a*, a green sub-pixel 60*b*, and a blue sub-pixel 60*c* arranged in a red-green-blue order with respect to the x-direction. As such, a first data line $\mathbf{50}_1$ may typically be connected to red sub-pixels 60, and a last data line $\mathbf{50}_n$ may typically be connected to blue sub-pixels 60. As the sub-pixels 60 of the first and last data lines $\mathbf{50}_1$ and $\mathbf{50}_n$ may generally have higher light transmittance due to uneven crosstalk effects, the edges 82 and 84 of a display area 80 may appear red at a first edge 82 and blue at a last edge 84 (also referred to as left edge 82 and right edge 84, respectively).

Furthermore, different portions of the display area may be affected by crosstalk differently depending on the image being displayed by the LCD 34. Crosstalk effects are generally more perceivable between two "ON" sub-pixels 60, or two activated sub-pixels 60 storing an electric field in response to a received image signal. For example, ON sub-pixels 60 may correspond with sub-pixels 60 which align the liquid crystal layer to transmit light, while "OFF" sub-pixels 60 may be deactivated and/or may correspond with sub-pixels 60 transmitting little or no light. The display controller 72 may sometimes drive a group of ON sub-pixels 60 adjacent to a group of OFF sub-pixels 60, such as when displaying an colored object in a black background. Due to the positioning of ON and OFF sub-pixels in the display area, areas of the display area may be differently affected by crosstalk, resulting in a non-uniform light transmission over the display area, such as higher light transmission at the y-direction edges (i.e., between adjacent ON sub-pixel 60 and OFF sub-pixels) of displayed objects.

Figure 7A:
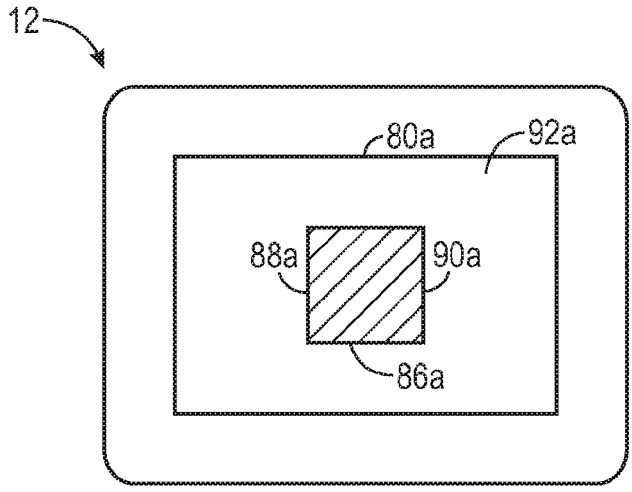
FIGS. 7A and 7B are illustrations of edge discoloration in objects displayed by the LCD of FIG. 4 in accordance with aspects of the present disclosure.
Figure 7B:
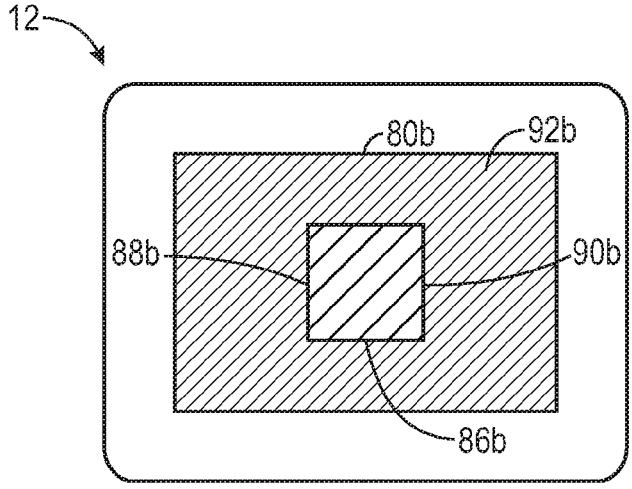

Higher light transmission at the edges of displayed objects may also manifest as edge discoloration, as illustrated in FIGS. 7A and 7B. FIG. 7A illustrates a display 12 displaying an object 86*a* in a display area 80*a*. The remaining portions of the display area 80*a* around the object 86*a* may be a white background 92*a*. To display white, the red, blue, and green sub-pixels 60 in the background 92*a* may all be transmitting light and may be in an ON state. In the illustrated example, the object 86*a* may be gray colored, such that the red, blue, and green sub-pixels 60 may be partially transmitting light (e.g., between an ON and OFF state). As crosstalk effects may be generally more perceptible between sub-pixels 60 in an ON state, the sub-pixels 60 transmitting the white background 92*a* which are adjacent to the sub-pixels 60 transmitting the gray object 86*a* may be less affected by crosstalk compared to other sub-pixels 60 which are adjacent to an ON sub-pixel on each side. This may result in higher light transmission through the sub-pixels 60 directly adjacent to the first edge

88*a* of the object 86*a* and the sub-pixels 60 directly adjacent to the last edge 90*a* of the object 86*a* (also referred to as the left edge 88*a* and the right edge 90*a*, respectively). In a red-green-blue pixel configuration, the ON sub-pixels 60 of the white background 92*a* may have reduced crosstalk effects, resulting in higher light transmission through the blue sub-pixels 60 directly adjacent to the left edge 88*a* and through the red sub-pixels 60 directly adjacent to the right edge 90*a*.

FIG. 7B illustrates a display 12 displaying an object 86*b* in a display area 80*b*. The remaining portions of the display area 80*b* around the object 86*b* may be a black background 92*b*. To display black, the red, blue, and green sub-pixels 60 in the background 92*b* may not transmit light and may be in an OFF state. In the illustrated example, the object 86*b* may be gray colored, such that the red, blue, and green sub-pixels 60 may be partially transmitting light (e.g., between an ON and OFF state). As crosstalk effects may be generally more perceptible between sub-pixels 60 in an ON state, the sub-pixels 60 of the black background 92*b* may not generally be affected by crosstalk, and the sub-pixels 60 transmitting the gray object 86*b* which are adjacent to the black background 92*b* may be less affected by crosstalk compared to other sub-pixels 60 in the object 86*b* which are not adjacent to OFF sub-pixels 60. This may result in higher light transmission through the sub-pixels 60 in the first edge 88*b* of the object 86*b* and in the last edge 90*b* of the object 86*b* (also referred to as the left edge 88*b* and the right edge 90*b*, respectively). In a red-green-blue pixel configuration, the sub-pixels 60 of the gray object 86*b* may have reduced crosstalk effects, resulting in higher light transmission through the red sub-pixels 60 at the left edge 88*b* and through the blue sub-pixels 60 at the right edge 90*b*.

Figure 8:
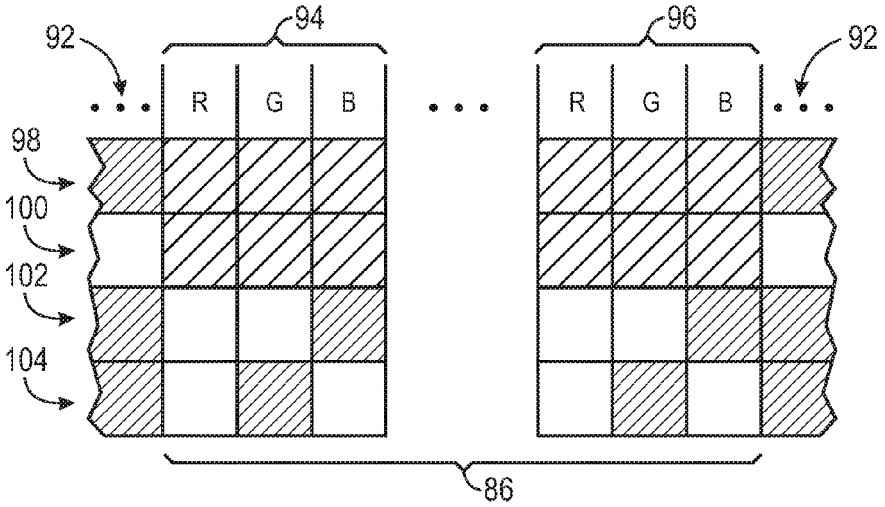
FIG. 8 is a diagram representing different sub-pixel schemes in forming different colored objects in a display area, in accordance with aspects of the present disclosure.

While gray objects 86*a* and 86*b* are used to explain edge discoloration in the examples of FIGS. 7A and 7B, edge discoloration may also be perceivable when displaying objects of other colors, as explained in the diagram FIG. 8. The diagram of FIG. 8 includes rows 98, 100, 102, and 104, which each represents a displayed object 86 in a background 92. The object 86 represented in each of the rows 98, 100, 102, and 104 is in a background 92 of a display area 80, and each of the objects 86 has a first pixel column 94 and a last pixel column 96, each including red, blue, and green sub-pixels. In each of the rows 98, 100, 102, and 104, the heavy shading represents little or no light transmission (e.g., OFF state) through the sub-pixels 60, the light shading represents partial light transmission (e.g., between OFF and ON states) through the sub-pixels 60, and no shading represents significant light transmission (e.g., ON state) through the sub-pixels 60. For example, row 98 represents a gray object 86 displayed in a black background, as discussed with respect to FIG. 7B, and row 100 represents a gray object 86 in a white background, as discussed with respect to FIG. 7A.

Row 102 represents a yellow object 86 in a black background 92. To transmit a perceived yellow color from the LCD 34, the red and green sub-pixels of the yellow object 86 may be ON and transmitting light, while the blue sub-pixel may be OFF. However, because the red sub-pixel 60 of the first pixel column 94 is adjacent to the black background 92, the red sub-pixel 60 may be less affected by crosstalk, and may have greater light transmission, such that the first edge of the yellow object 86 appears reddish. Similarly, the green sub-pixel 60 of the last column 96 is adjacent to the blue sub-pixel 60 which is in an OFF state. Thus, the green sub-pixel 60 of the last column 96 may be less affected by crosstalk and have greater light transmission, such that the last edge of the yellow object 86 appears greenish. Similarly, row 104 represents a magenta object 86 on a black background 92, and due to the reduced crosstalk effects and higher light transmission through the red sub-pixel 60 of the first pixel column 94 and through the blue sub-pixel 60 of the last pixel column 96, the magenta object 86 may appear to have a reddish first edge and a bluish last edge.

Figure 12:
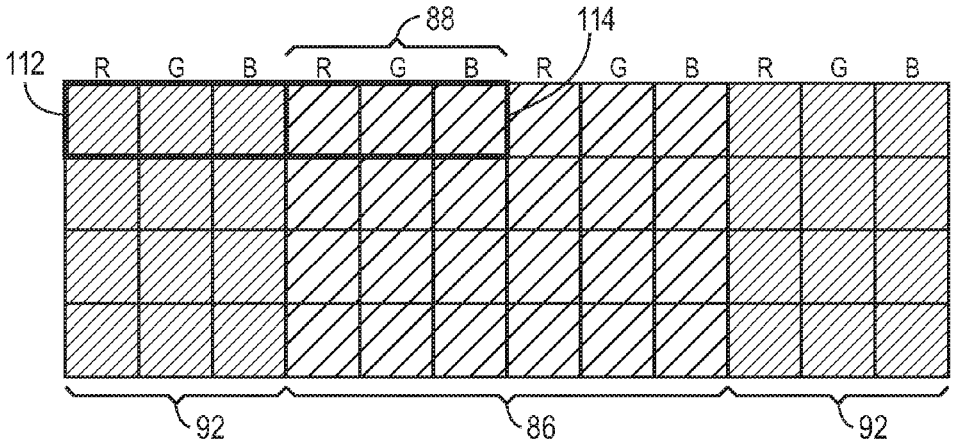
FIG. 12 is a diagram representing a detected edge between a black background and a gray object, in accordance with aspects of the present disclosure.
Figure 13:
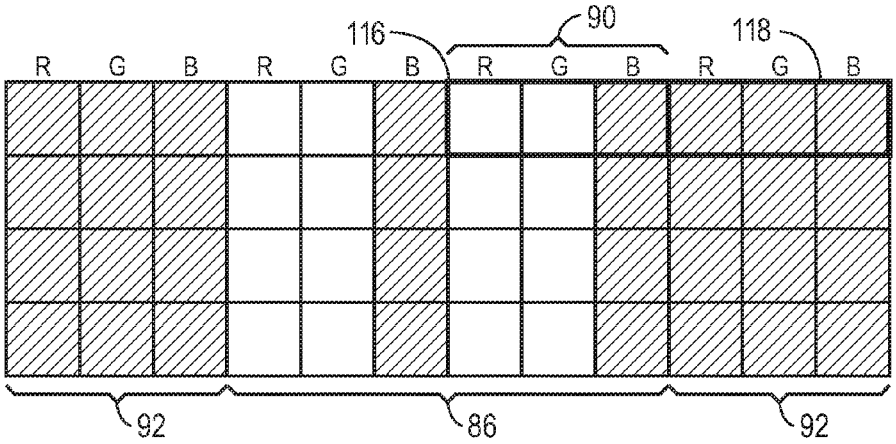
FIG. 13 is a diagram representing a detected edge between a yellow object and a black background, in accordance with aspects of the present disclosure.

One or more embodiments provide techniques for reducing the perceptibility of edge discoloration at the left and right edges 82 and 84 of a display area 80 and/or at the left and right edges 88 and 90 of an object 86 displayed in a display area 80. Various embodiments are provided in FIGS. 9-14, wherein FIGS. 9-11 provide embodiments directed towards reducing edge discoloration in the edges 82 and 84 of a display area 80, and FIGS. 12-14 provide embodiments directed towards reducing edge discoloration in edges 88 and 90 of a displayed object 86.

Figure 9:
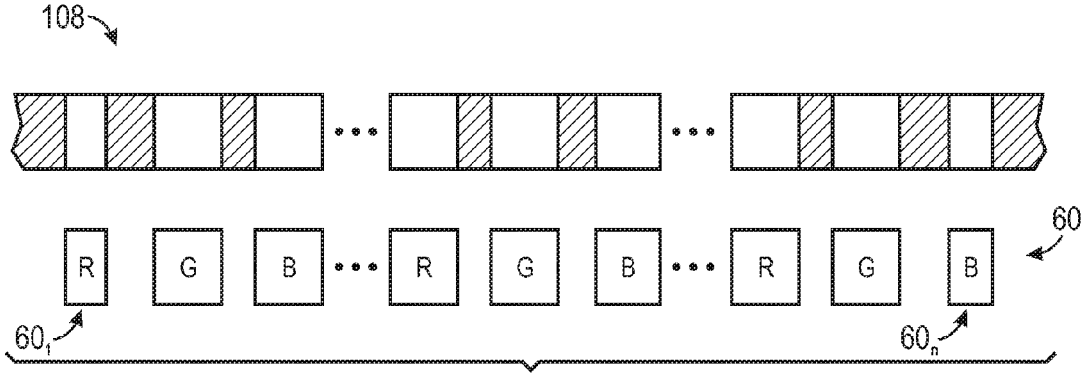
FIG. 9 is a diagram representing a black mask and the corresponding sub-pixels covered by the black mask, in accordance with aspects of the present disclosure.

Beginning first with FIG. 9, one embodiment for reducing edge discoloration at the left and right edges 82 and 84 of a display area 80 includes configuring a black mask 108 to decrease the amount of light transmitted through the sub-pixels 60 connected to the first and last data lines $\mathbf{50}_1$ and $\mathbf{50}_n$ of a pixel matrix 70. One row of sub-pixels 60 and a corresponding portion of a black mask 108 is represented in FIG. 9, where the portions of the black mask over the first red sub-pixel $\mathbf{60}_1$ and the last blue sub-pixel $\mathbf{60}_n$ may be configured to cover a greater area of each of the first and last sub-pixels $\mathbf{60}_1$ and $\mathbf{60}_n$. Covering more of light-transmitting areas of the first and last sub-pixels $\mathbf{60}_1$ and $\mathbf{60}_n$ connected to the first and last data lines $\mathbf{50}_1$ and $\mathbf{50}_n$ may compensate for the effect of higher light transmission through the sub-pixels $\mathbf{60}_1$ and $\mathbf{60}_n$ due to comparatively less crosstalk effects, which may reduce the perceptibility of edge discoloration at the edges 82 and 84. In different embodiments, the black mask 108 may be configured to cover any percentage of the first and last sub-pixels $\mathbf{60}_1$ and $\mathbf{60}_n$, depending on the configuration of the LCD 34 and/or the predicted transmission of light through first and last sub-pixels $\mathbf{60}_1$ and $\mathbf{60}_n$. Furthermore, in some embodiments, more than the first and last sub-pixels $\mathbf{60}_1$ and $\mathbf{60}_n$ may be configured for reduced light transmittance. For example, in some embodiments, the black mask 108 may also be configured to reduce light transmission through the sub-pixels $\mathbf{60}_2$ and $\mathbf{60}_{n-1}$.

Figure 10A:
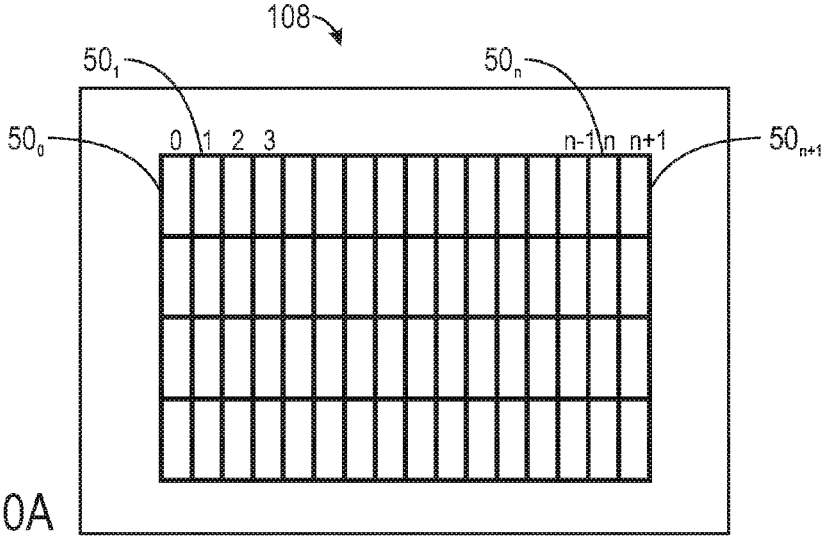
FIGS. 10A and 10B are diagrams representing a view of a pixel matrix in the LCD of FIG. 4 and a view of the black mask over the pixel matrix, in accordance with aspects of the present disclosure.
Figure 10B:
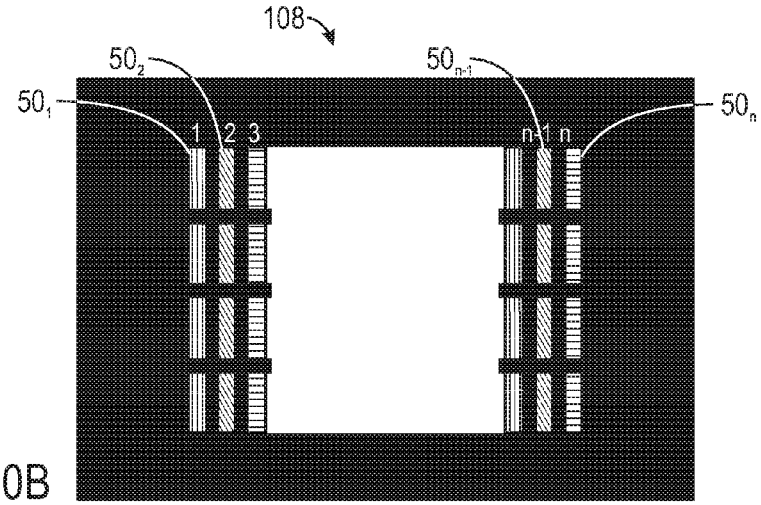

In some embodiments, the black mask 108 may be configured to completely cover a first and last column of "dummy" sub-pixels 60, as illustrated in FIGS. 10A and 10B. As provided in FIG. 10A, the pixel matrix 70 may include an additional column of dummy sub-pixels connected to data lines $\mathbf{50}_0$ and $\mathbf{50}_{n+1}$. The sub-pixels connected to data lines $\mathbf{50}_0$ and $\mathbf{50}_{n+1}$ may be driven with the same or similar data gray scale level as the adjacent sub-pixels 60 (e.g., sub-pixels 60 connected to data lines $\mathbf{50}_1$ and $\mathbf{50}_n$), but the black mask 108 may completely cover these sub-pixels 60, as shown in FIG. 10B, such that the sub-pixels 60 which are visible at the edges 82 and 84 may have the same crosstalk effects and similar light transmittance properties as other sub-pixels 60 in the display area 80, thus reducing the perceptibility of edge discoloration.

Figure 11:
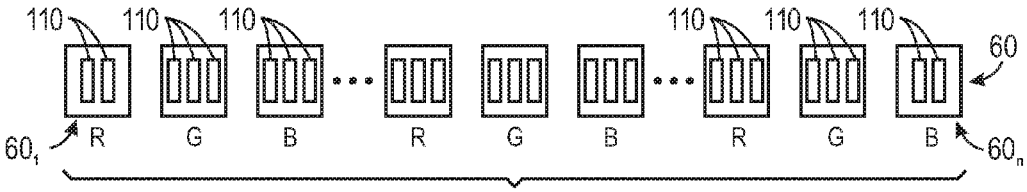
FIG. 11 is a diagram representing finger electrodes in a row of sub-pixels, in accordance with aspects of the present disclosure.

Another embodiment for reducing edge discoloration at the left and right edges 82 and 84 of a display area 80 is provided in FIG. 11, which represents one row of sub-pixels 60, including a sub-pixel $\mathbf{60}_1$ connected to a first data line $\mathbf{50}_1$ and a sub-pixel $\mathbf{60}_n$ connected to a last data line $\mathbf{50}_n$. The finger electrodes 110 in the first and last sub-pixels $\mathbf{60}_1$ and $\mathbf{60}_n$ may be configured for reduced light transmittance. As the area of the pixel electrode 54 generally correlates with the light-transmitting area of the pixel 60, reducing the number of finger electrodes 110 in the pixel electrodes 54 of the first and last sub-pixels $\mathbf{60}_1$ and $\mathbf{60}_n$ may reduce light transmission of those sub-pixels $60_1$ and $60_n$ in comparison with other sub-pixels 60, thereby compensating for the increased light transmission through the first and last sub-pixels $60_1$ and $60_n$ and reducing the edge discoloration at the left and right edges 82 and 84 of the display area 80. For example, in some embodiments, sub-pixels 60 may typically have 3 finger electrodes 110, and the first and last sub-pixels $60_1$ and $60_n$ may each have 2 finger electrodes 110. In different embodiments, other finger electrode configurations are also possible (e.g., thinner finger electrodes, or differently shaped finger electrodes). Furthermore, in some embodiments, more than the first and last sub-pixels $60_1$ and $60_n$ may be configured for reduced light transmittance. For example, in some embodiments, the finger electrodes 110 in sub-pixels $60_2$ and $60_{n-1}$ may also be configured for reduced light transmittance.

In some embodiments, the brightness of the sub-pixels 60 connected to the first and last data lines $50_1$ and $50_n$ may be automatically reduced by using software. For example, the display controller 72 (FIG. 5) may send a data signal to the red, green, and blue sub-pixels $[R_1, G_1, B_1]$ and $[R_n, G_n, B_n]$ of a first and last pixel column, respectively, using the relationships $[R_1*x, G_1, B_1]$ and $[R_n, G_n, B_n*k]$, where x and k may be the same or different, and are attenuation factors having values between 0 and 1. By reducing the brightness of the red and blue sub-pixels 60 of the first and last data lines $50_1$ and $50_n$, the display controller 72 may automatically reduce the perceptibility of edge discoloration without any changes to the hardware or design of the LCD 34. In some embodiments, the values x and k may be determined empirically, and may also be determined dynamically during an operation of the LCD 34. Further, in some embodiments, more than the first and last data lines $50_1$ and $50_n$ may be adjusted. For example, the relationship $[R_1*x, G_1*y, B_1]$ and $[R_n, G_n*j, B_n*k]$ may be used to compensate for edge discoloration at the first and last two data lines 50.

The present techniques may also include embodiments for reducing edge discoloration at the edges 88 and 90 of a displayed object 86, as will be discussed with respect to FIGS. 12-14. In one embodiment, the data signals corresponding to the edges 88 and/or 90 of an object 86 may be modified to reduce edge discoloration. For example a gray object 86 may be displayed in a black background 92, as illustrated in FIG. 12. Potential edge discoloration may be detected by detecting abrupt edges in a display area. For example, the display controller 12 (or another suitable controller coupled to the display controller 12) may determine an abrupt edge when the blue sub-pixel 60 of one pixel 112 and the red sub-pixel 60 of an adjacent pixel 114 are driven by data signals having a difference greater than a threshold value. The threshold may be determined empirically depending on the configuration of the LCD 34 and/or on the images to be displayed by the LCD 34. In some embodiments, if the difference between blue sub-pixel 60 of the pixel 112 and the red sub-pixel 60 of the pixel 114 is greater than the threshold, the last sub-pixel 60 of the background pixel 112 and the first sub-pixel 60 of the object pixel 114 may be compensated according to $[R_{112}, G_{112}, B_{112}*C1]$ and $[R_{114}*C2, G_{114}, B_{114}]$, where C1 and C2 may be the same or different, and may each be greater than 0 and less than 1. The values C1 and C2 may be determined to reduce the difference between the adjacent sub-pixels 60 corresponding to the abrupt edges, such that potential edge discoloration resulting from the abrupt edges may be reduced. In some embodiments, a similar compensation may be applied to a detected abrupt edge from the transition of the object 86 to the background 92.

In some embodiments, abrupt edges may also be detected when the difference in data signals is not detected between the last sub-pixel 60 of a background pixel and the first sub-pixel 60 of an object pixel. For example, as illustrated in FIG. 13, the object 86 may be yellow (e.g., transmitting through the red and green sub-pixels 60) and in a black background 92. Since the blue sub-pixels 60 of the object 86 are substantially in an OFF state, an abrupt edge may be detected between the ON green sub-pixel 60 and the OFF blue sub-pixel 60 of the pixel 116. If the difference between the green sub-pixel 60 and the blue sub-pixel 60 of the pixel 116 is greater than a threshold, the pixel 116 may be compensated according to $[R_{116}, G_{116}*C3, B_{116}*C4]$, where C3 and C4 may each be greater than 0 and less than 1.

One or more embodiments may also involve configuring the shape of sub-pixel electrodes 54 such that each sub-pixel 60 may have a controlled coupling effect with its adjacent sub-pixels 60. The controlled coupling effect may increase coupling between two adjacent sub-pixels 60 when one of the sub-pixels 60 is in an ON state and when its adjacent sub-pixel is in an OFF state. By increasing coupling between a pair of ON and OFF adjacent sub-pixels, light transmission may be reduced through the ON sub-pixel and/or increased through the OFF sub-pixel, thereby reducing possible edge discoloration.

Figure 14A:
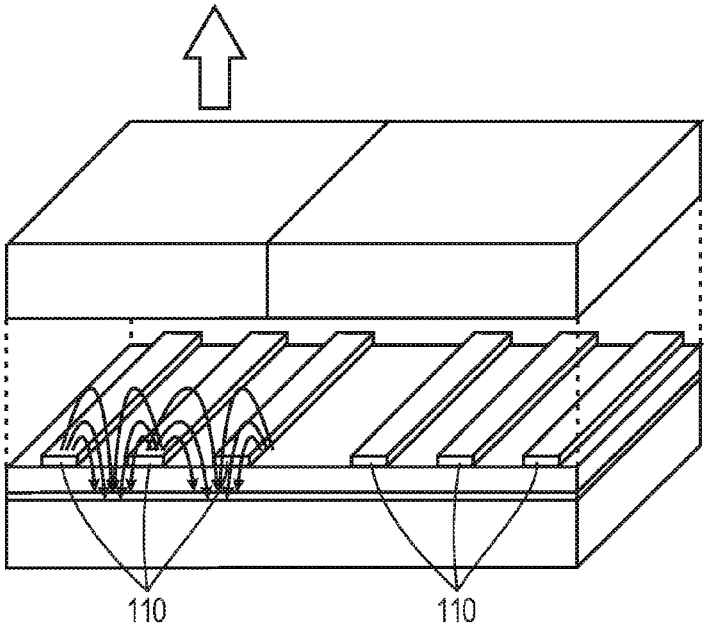
FIGS. 14A and 14B compare a finger electrode configuration in a typical sub-pixel with a finger electrode having a coupling extrusion in a sub-pixel configured to reduce edge discoloration.
Figure 14B:
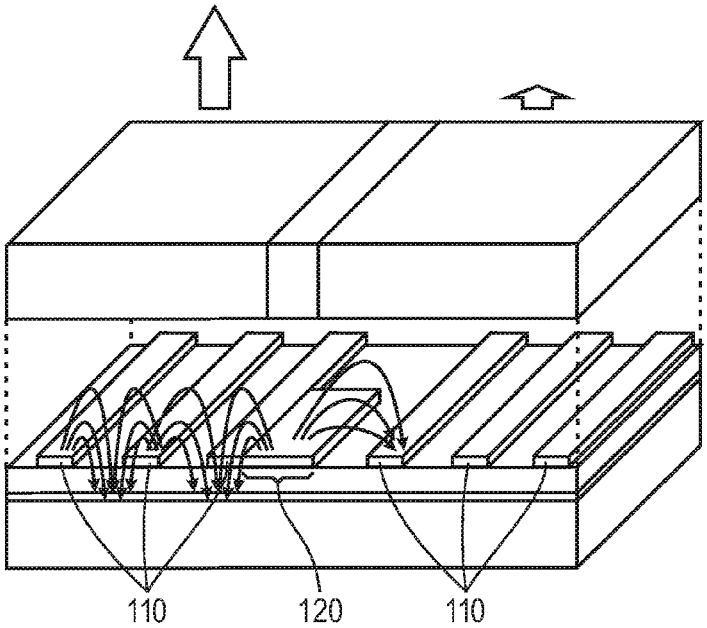

For example, in some embodiments as provided in FIGS. 14A and 14B, each sub-pixel electrode 54 may include a coupling extrusion designed to result in an amount of coupling that reduces edge discoloration while preserving desirable visual attributes. The diagram of FIG. 14A provides a typical configuration of finger electrodes 110 in two adjacent sub-pixels 60. As crosstalk is greater when a sub-pixel 60 is in an ON state, crosstalk may generally occur between the finger electrodes 110 of the ON state sub-pixel, and may not occur at the finger electrodes 110 of the OFF sub-pixel. As discussed, sub-pixels 60 adjacent to OFF sub-pixels may be less affected by crosstalk, and may transmit more light than other ON sub-pixels, possibly resulting in edge discoloration. The diagram of FIG. 14B provides one embodiment of finger electrodes 110 including a coupling extrusion 120. The coupling extrusion 120 may be an extension of the finger electrodes 110 and configured to increase coupling between ON and OFF sub-pixels 60. Increasing coupling between ON and OFF sub-pixels 60 may reduce light transmission through the ON sub-pixel 60 and increase light transmission through the OFF sub-pixel 60, thus reducing the perceptibility of edge discoloration.

In different embodiments, different combinations of the above techniques may be used. Though embodiments directed to display area edge discoloration (FIGS. 9-11) and displayed object edge discoloration (FIG. 12-14) are separately presented, any of the techniques may be combined. For example, a black mask 108 may be adjusted for the sub-pixels 60 connected to the first and last data lines $50_1$ and $50_n$, and all sub-pixels 60 may be configured with a coupling extrusion 120. Furthermore, software compensation may also be used in conjunction with any hardware modifications.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A liquid crystal display (LCD) comprising:

a plurality of sub-pixels, comprising:

sub-pixels arranged in a first column on one edge of a display area of the LCD, wherein the sub-pixels in the first column are coupled a first data line;

sub-pixels arranged in a last column on an opposite edge of the display area from the first column, wherein the sub-pixels in the last column are coupled to a second data line; and intermediate sub-pixels between the first column and the last column, wherein the sub-pixels arranged in the first column and the sub-pixels arranged in the last column are each configured to transmit less light out of the LCD in response to a first data signal compared to a light transmitted out of the LCD by the intermediate sub-pixels in response to the first data signal, wherein each of the sub-pixels arranged in the first column and each of the sub-pixels arranged in the last column comprises an electrode having a first transmitting area, wherein each of the intermediate sub-pixels comprises an electrode having a second transmitting area, and wherein the first transmitting area is smaller than the second transmitting area.

2. A liquid crystal display (LCD) comprising:

a plurality of sub-pixels, comprising:

sub-pixels arranged in a first column on one edge of a display area of the LCD, with respect to a plane of the LCD;

sub-pixels arranged in a last column on an opposite edge of the display area from the first column; and intermediate sub-pixels between the first column and the last column, wherein the sub-pixels arranged in the first column and the sub-pixels arranged in the last column are each configured to transmit less light out of the LCD in response to a first data signal compared to a light transmitted out of the LCD by the intermediate sub-pixels in response to the first data signal, wherein each of the sub-pixels arranged in the first column and each of the sub-pixels arranged in the last column has only two finger electrodes, and wherein each of the intermediate sub-pixels comprises three finger electrodes.

3. The LCD of claim 1, wherein at least one sub-pixel in the plurality of sub-pixels comprises an electrode comprising a coupling extrusion configured to electrically couple with an electrode of an adjacent sub-pixel.

4. The LCD of claim 3, wherein the coupling extrusion is configured to reduce edge discoloration in the LCD compared to an LCD not having a coupling extrusion while maintaining image sharpness of the LCD compared to the LCD not having a coupling extrusion.

5. The LCD of claim 3, wherein the coupling extrusion increases crosstalk between an activated sub-pixel and a deactivated sub-pixel.

6. A display comprising:

a pixel matrix comprising a plurality of sub-pixels;

a display controller configured to:

identify first and second sets of sub-pixel directly adjacent to an edge, wherein the first and second sets of sub-pixels are on opposing sides of the edge;

determine a difference between a first set of data signals associated with the first set of sub-pixels and a second set of data signals associated with the second set of sub-pixels, wherein the second set of sub-pixels are directly adjacent to the first set of sub-pixels;

determine modified data signals for the first set of sub-pixels based on the difference; and transmit the modified data signals to the first set of sub-pixels and the second set of signals to the second set of sub-pixels, wherein the first set of sub-pixels transmits less light in response to the modified data signals than in response to the first set of data signals.

7. The display of claim 6, wherein the first set of sub-pixels comprises sub-pixels of an object displayed in a display area of the display, wherein the first set of sub-pixels is substantially transmitting light and wherein the second set of sub-pixels is not substantially transmitting light.

8. The display of claim 6, wherein the first set of sub-pixels comprises sub-pixels directly adjacent to an object displayed in a display area of the display, wherein the first set of sub-pixels is substantially transmitting light and wherein the second set of sub-pixels is transmitting less light than the first set of sub-pixels.

9. The display of claim 6, wherein the pixel matrix comprises display edge sub-pixels, wherein the display edge sub-pixels are connected to a first data line and a last data line, wherein the first data line and the last data line are on opposite edges of the pixel matrix.

10. The display of claim 9, comprising a black mask disposed over the pixel matrix, wherein the black mask is configured to cover a first percentage of area of each of a display edge sub-pixel and cover a second percentage of area of each of the plurality of sub-pixels, wherein the first percentage is greater than the second percentage.

11. The display of claim 9, wherein each of the plurality of sub-pixels comprises a pixel electrode having a first transmitting area, and each of the display edge sub-pixels comprises a second transmitting area, wherein the first transmitting area is greater than the second transmitting area.

12. The display of claim 6, wherein the modified data signals correspond to the first set of data signals reduced by an attenuation factor.

13. The display of claim 12, wherein the attenuation factor is a value between 0 and 1.

14. The display of claim 6, wherein each of the plurality of sub-pixels comprises a pixel electrode comprising a coupling extrusion configured to electrically couple with a neighboring sub-pixel.

15. The display of claim 14, wherein the coupling extrusion is configured to enable significant coupling between a substantially transmitting sub-pixel and an adjacent substantially non-transmitting pixel.

16. A display system, comprising:

a plurality of sub-pixels arranged to form a display area of the display system; and a display controller configured to:

drive data signals corresponding to an image frame to each of the plurality of sub-pixels;

detect an edge within the image frame, wherein the edge is located between an object displayed in the display area and a background of the display area;

drive modified data signals to edge sub-pixels of the plurality of sub-pixels which correspond to the detected edge within the image frame; and drive unmodified data signals to remaining sub-pixels of the plurality of sub-pixels, wherein the edge sub-pixels transmit less light in response to the modified data signals compared to unmodified data signals.

17. The display system of claim 16, wherein the edge comprises a change in light transmittance between a sub-pixel of the object and a sub-pixel of the background, wherein the change in light transmittance is greater than a threshold.

18. The display system of claim 16, wherein the edge comprises a change in light transmittance between two sub-pixels of the object, wherein the change in light transmittance is greater than a threshold.

19. A method of reducing edge discoloration in a display having a plurality of sub-pixels, the method comprising:

identifying an edge in an image frame;

detecting edge sub-pixels that are directly adjacent to the edge in the image frame, wherein locations of the edge sub-pixels in the display change during operation of the display;

transmitting modified data signals to the edge sub-pixels; and transmitting unmodified data signals to the remaining sub-pixels, wherein the edge sub-pixels transmit less light in response to the modified data signals than in response to the unmodified data signals.

20. The method of claim 19, wherein the method is performed dynamically during an operation of the display.

* * * * *

UNITED STATES PATENT AND TRADEMARK OFFICE

CERTIFICATE OF CORRECTION

PATENT NO. : 8,854,401 B2
APPLICATION NO. : 12/979768
DATED : October 7, 2014
INVENTOR(S) : Cheng Chen et al.

It is certified that error appears in the above-identified patent and that said Letters Patent is hereby corrected as shown below:

In the Claims,

Col. 13, line 6, In claim 1, delete "coupled a first data line" and insert -- coupled to a first data line --

Signed and Sealed this
Thirteenth Day of January, 2015

Michelle K. Lee

Michelle K. Lee
*Deputy Director of the United States Patent and Trademark Office*